US007874404B1

(12) United States Patent
Adams et al.

(10) Patent No.: US 7,874,404 B1
(45) Date of Patent: Jan. 25, 2011

(54) ELEVATOR SYSTEM HAVING DRIVE MOTOR LOCATED BETWEEN ELEVATOR CAR AND HOISTWAY SIDEWALL

(75) Inventors: Frank W. Adams, Avon, CT (US); Leandre Adifon, Farmington, CT (US); Pedro Baranda, Farmington, CT (US); Marc Chevilliard, Penang (MY); Jean-Noel Cloux, Les Choux (FR); Masashi Kawarasaki, Narashino (JP); Yutaka Matsumoto, Kawasaki (JP); Jean-Pierre Menard, Bourg la Reine (FR); Jean-Pierre Pougny, Saint Gordon (FR); Bruce St. Pierre, Bristol, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/163,259

(22) Filed: Sep. 29, 1998

(51) Int. Cl.
*B66B 7/02* (2006.01)
*B66B 11/08* (2006.01)

(52) U.S. Cl. ..... 187/406; 187/254; 187/266

(58) Field of Classification Search ..... 187/264, 187/406, 411, 251, 254, 266, 249, 408; *B66B 11/08, B66B 7/02, 11/00, 11/04*
See application file for complete search history.

(56) References Cited

U.S. PATENT DOCUMENTS 975,790 A * 11/1910 Pearson ..... 187/254
1,011,423 A * 12/1911 Gale ..... 187/254
1,035,230 A * 8/1912 Pearson ..... 187/254
1,047,330 A 12/1912 Sundh
1,051,335 A * 1/1913 King ..... 187/408
1,071,309 A 8/1913 Goggin
1,132,769 A * 3/1915 Gale ..... 187/264
1,138,547 A 5/1915 Dunn et al.
1,164,115 A 12/1915 Pearson
1,475,250 A 11/1923 Sundh
1,477,886 A * 12/1923 Lewis ..... 474/271
1,782,671 A 11/1930 Allred, Jr.
1,853,085 A 4/1932 Scannell
2,526,324 A 10/1950 Bloomfield
2,798,574 A 7/1957 Wardell
3,101,130 A 8/1963 Giuseppe (Continued)

FOREIGN PATENT DOCUMENTS

AU 1 032 496 6/1958

(Continued)

OTHER PUBLICATIONS

"Elevator Mechanical Design, Principles and Concepts", by Lubomir Janovsky, Ellis Horwood Limited (1987).

(Continued)

*Primary Examiner*—Michael R Mansen
*Assistant Examiner*—Stefan Kruer
(74) *Attorney, Agent, or Firm*—Carlson, Gaskey & Olds PC

(57) ABSTRACT

An elevator system includes a hoistway defined by a surrounding structure. An elevator car and counterweight are located in the hoistway, and a drive motor is located between the elevator car and a sidewall of the hoistway. The drive motor drivingly couples and suspends the elevator car and counterweight via at least one flat rope or belt.

14 Claims, 6 Drawing Sheets

U.S. PATENT DOCUMENTS

| | | | | |
|---|---|---|---|---|
| 3,174,585 | A | | 3/1965 | Tofanelli |
| 3,279,762 | A | | 10/1966 | Bruns |
| 3,395,530 | A | | 8/1968 | Campbell |
| 3,750,849 | A | | 8/1973 | Berkovitz |
| 3,756,350 | A | | 9/1973 | Gandolfo et al. |
| 3,824,777 | A | | 7/1974 | Riggs |
| 3,910,382 | A | | 10/1975 | Justice |
| 3,922,841 | A | | 12/1975 | Katsumata et al. |
| 4,004,655 | A | | 1/1977 | Kraft et al. |
| 4,013,142 | A | | 3/1977 | Hagg |
| 4,050,230 | A | | 9/1977 | Senoo et al. |
| 4,202,164 | A | | 5/1980 | Simpson et al. |
| 4,216,856 | A | | 8/1980 | Moring et al. |
| 4,227,041 | A | | 10/1980 | Den et al. |
| 4,344,278 | A | | 8/1982 | Jamison et al. |
| 4,388,837 | A | | 6/1983 | Bender |
| 4,402,488 | A | | 9/1983 | Berkovitz |
| 4,422,286 | A | | 12/1983 | Simpson et al. |
| 4,445,593 | A | | 5/1984 | Coleman et al. |
| 4,519,262 | A | | 5/1985 | Le et al. |
| 4,534,163 | A | | 8/1985 | Schuerch |
| 4,557,465 | A | | 12/1985 | Lundberg |
| 4,570,753 | A | | 2/1986 | Ohta et al. ..... 187/1 |
| 4,609,181 | A | | 9/1986 | Fisher et al. |
| 4,664,230 | A | * | 5/1987 | Olsen |
| 4,724,929 | A | | 2/1988 | Coleman et al. |
| 4,877,060 | A | | 10/1989 | Froment et al. |
| 4,947,636 | A | | 8/1990 | Sinopoli |
| 4,947,638 | A | | 8/1990 | Nagamine et al. |
| 4,949,815 | A | | 8/1990 | Pavoz ..... 187/20 |
| 5,054,578 | A | | 10/1991 | Smillie, III et al. |
| 5,112,933 | A | | 5/1992 | O'Donnell et al. |
| 5,129,866 | A | | 7/1992 | Schanin et al. |
| 5,170,995 | A | | 12/1992 | Bitsch et al. |
| 5,209,987 | A | | 5/1993 | Penneck et al. |
| 5,299,661 | A | | 4/1994 | Pramanik et al. |
| 5,318,154 | A | | 6/1994 | Hellman, Jr. et al. |
| 5,348,273 | A | | 9/1994 | Sandell et al. |
| 5,388,175 | A | | 2/1995 | Clarke |
| 5,429,211 | A | | 7/1995 | Aulanko et al. |
| 5,435,417 | A | | 7/1995 | Hakala ..... 187/404 |
| 5,461,850 | A | | 10/1995 | Bruyneel et al. |
| 5,469,937 | A | * | 11/1995 | Hakala et al. ..... 187/266 |
| 5,490,578 | A | | 2/1996 | Aulanko et al. ..... 187/254 |
| 5,526,552 | A | | 6/1996 | De Angelis |
| 5,531,256 | A | | 7/1996 | Hashimoto et al. |
| 5,566,786 | A | | 10/1996 | De Angelis et al. |
| 5,593,366 | A | | 1/1997 | Puzik |
| 5,605,035 | A | | 2/1997 | Pethrick et al. |
| 5,610,217 | A | | 3/1997 | Yarnell et al. |
| 5,636,712 | A | * | 6/1997 | Muller et al. ..... 187/249 |
| 5,651,245 | A | | 7/1997 | Damien |
| 5,845,396 | A | | 12/1998 | Altman et al. |
| 5,845,745 | A | * | 12/1998 | Lane ..... 187/406 X |
| 5,855,254 | A | | 1/1999 | Blochle |
| 5,881,843 | A | | 3/1999 | O'Donnell et al. |
| 5,921,351 | A | * | 7/1999 | Schroder-Brumloop ..... 187/255 |
| 5,992,574 | A | | 11/1999 | Olsen et al. |
| 5,993,924 | A | | 11/1999 | Deroch et al. |
| 6,138,799 | A | | 10/2000 | Schroder-Brumloop et al. |

FOREIGN PATENT DOCUMENTS

| | | | | |
|---|---|---|---|---|
| BE | 501611 | | | 3/1951 |
| CN | 1121040 | A | | 4/1996 |
| CN | 1133261 | C | | 10/1996 |
| DE | 1 000 138 | | | 1/1957 |
| DE | 1032496 | | | 6/1958 |
| DE | 1 033 383 | | | 7/1958 |
| DE | 436 619 | | | 11/1967 |
| DE | 1679881 | U | | 3/1972 |
| DE | 2136540 | | | 2/1973 |
| DE | 2307104 | A | | 8/1973 |
| DE | 2333120 | | | 1/1975 |
| DE | 3345704 | A1 | | 6/1985 |
| DE | 3802386 | | | 8/1988 |
| DE | T-7395 | | | 11/1992 |
| DE | 2333120 | | | 1/1995 |
| DE | 296 15 921 | U1 | | 4/1997 |
| DE | 29710732 | | | 9/1997 |
| EP | 0100583 | B1 | | 2/1984 |
| EP | 0565516 | A1 | | 10/1993 |
| EP | 0 606 875 | A1 | | 1/1994 |
| EP | 0 779 223 | A2 | | 6/1994 |
| EP | 0 784 030 | A2 | | 6/1994 |
| EP | 0 680 920 | | | 5/1995 |
| EP | 0 710 618 | A2 | | 10/1995 |
| EP | 0 719 724 | | | 12/1995 |
| EP | 0686594 | | | 12/1995 |
| EP | 0688735 | | | 12/1995 |
| EP | 0710618 | | * | 5/1996 |
| EP | 710618 | A2 | * | 5/1996 |
| EP | 0710618 | A2 | | 5/1996 |
| EP | 0 749 930 | A2 | | 6/1996 |
| EP | 0 749 931 | A2 | | 6/1996 |
| EP | 0719724 | | | 7/1996 |
| EP | 0 846 645 | | | 11/1997 |
| EP | 0631967 | B1 | | 12/1997 |
| EP | 0841283 | B1 | | 5/1998 |
| EP | 0 688 735 | A2 | | 6/1999 |
| EP | 0719724 | B2 | | 8/2005 |
| ES | 405037 | A | | 7/1972 |
| ES | 2225925 | T | | 11/1997 |
| FR | 2293392 | A1 | | 7/1976 |
| FR | 2 640 604 | | | 12/1988 |
| GB | 1051587 | A | | 12/1966 |
| GB | 1052264 | A | | 12/1966 |
| GB | 1184997 | A | | 3/1970 |
| GB | 1 401 197 | | | 6/1972 |
| GB | 1295718 | | | 11/1972 |
| GB | 1362514 | | | 8/1974 |
| GB | 2 223 471 | | | 12/1983 |
| GB | 2125362 | | | 7/1984 |
| GB | 2134209 | A | | 8/1984 |
| GB | 2 138 397 | B | | 11/1985 |
| GB | 2162283 | A | | 1/1986 |
| GB | 2201657 | | | 9/1988 |
| GB | 2 2-1 657 | B | | 8/1990 |
| JP | 58-184480 | | | 9/1954 |
| JP | 4-50297 | | | 1/1957 |
| JP | 48-15497 | | | 5/1973 |
| JP | 49-20811 | B | | 5/1974 |
| JP | 59-102780 | | | 6/1984 |
| JP | 63-178277 | | | 11/1988 |
| JP | 63-178278 | | | 11/1988 |
| JP | 1-242386 | | | 9/1989 |
| JP | 1-267286 | | | 10/1989 |
| JP | 1266341 | A | | 10/1989 |
| JP | 3003883 | A | | 1/1991 |
| JP | 5039180 | A | | 2/1993 |
| JP | 5-70057 | | | 3/1993 |
| JP | 06345367 | A | * | 12/1994 |
| JP | 7-97165 | | | 4/1995 |
| JP | 8-208152 | | | 8/1996 |
| JP | 8-231163 | | | 9/1996 |
| JP | 09-21084 | | | 1/1997 |
| JP | 10-081463 | | | 3/1998 |
| KR | 10-1997-0001191 | | | 1/1997 |
| SU | 505764 | A | | 4/1976 |
| SU | 1216120 | A | | 3/1986 |
| WO | PCT/FI95/00530 | | | 9/1995 |
| WO | WO 96/09978 | | | 4/1996 |
| WO | PCT/FI97/00823 | | | 12/1997 |
| WO | PCT/FI97/00824 | | | 12/1997 |

| | | |
|---|---|---|
| WO | 98/16681 | 4/1998 |
| WO | 98/29326 | 7/1998 |
| WO | 98/29327 | 7/1998 |
| WO | PCT/FI98/00205 | 9/1998 |
| WO | PCT/FI98/00207 | 9/1998 |
| WO | PCT/EP98/02549 | 11/1998 |

OTHER PUBLICATIONS

"Hannover Fair: Another new idea from ContiTech—Lifting belts for elevators", ContiTech initiav Jan. 1998 (Hannover Fair '98).
"Der Fahrstuhl", by Die, Geschichte, der vertikalen Eroberung, 9 Siemens, Anm. 2, S. 373 (1984).
PCT Search Report for Serial No. PCT/US99/03645 dated Jun. 16, 1999.
European Patent Office, Preliminary Remarks in opposition of EP 1066213 B1 (related to the present application), Jan. 21, 2008, 6 pgs.
European Patent Office, Communication in opposition of EP 1066213 B1 (related to the present application), Jun. 5, 2008, 4 pgs.
European Committee for Standardization, EN 81-1:1998, pp. 1-5; 14-16; 55-56; 198.
Office Action dated Oct. 28, 2008 issued in Japanese Counterpart Application No. 2000-533355.
Opposition of European Patent EP 1 060 305 B1 (hereinafter EP'305 Opposition), (translation of) Opponents Request for Opposition of Apr. 11, 2006.
EP'305 Opposition, (translation of) Opponents Additional Brief of Oct. 27, 2006.
EP'305 Opposition, (translation of) Opponents Additional Brief of Dec. 20, 2006.
EP'305 Opposition, Patentee's Observations of Jun. 11, 2007.
EP'305 Opposition, (translation of) Intervenor's Notice of Intervention of Feb. 22, 2008.
EP'305 Opposition, Patentee's Observations of Dec. 23, 2008.
Hoxter Arntz-Optibel-Gruppe (Editer), "Keilriemen, eine Monografie", Essen, Germany, 1972, Verlag Ernst Heyer (Publisher).
Karl-Heinz Decker, "Maschinenelemente, Gestaltung und Berechnung", Munich, Germany, 1995, Carl_Henser-Verlag (Publisher).
Gustav, Niemann et al. "Maschinenelemente", Berlin, Germany, 1986, Springer-Verlag (Publisher).
European Commitee for Standardization, "European Standard EN81-1, Safety Rules for the Construction and Installation of Lifts, Part 1: Electric Lifts", various pp. (1-5,14-16, 55, 56 and 198), Feb. 1998, Brussels, Belgium.
Opposition of European Patent EP 1 153 167 B1 (hereinafter EP '167 Opposition), (translation of) Opponents Request for Opposition of Jul. 28, 2006.
EP '167 Opposition, Patentee's Observations of Oct. 19, 2007.
EP '167 Opposition, Decision by EPO Opposition Division of Sep. 12, 2008.
EP '167 Opposition, (translation of) Opponent's Grounds of Appeal of Jan. 21, 2009.
EP '167, (translation of) Assumed Infringer's Grounds of Appeal of Jan. 22, 2009.
EP '167, Patentee's Response to Grounds of Appeal of Sep. 7, 2009.
Cancellation Proceeding regarding German Utility Model DE 299 24 760 (hereinafter "DE '760 Cancellation"), (translation of) Notice of Request for Cancellation of Jan. 25, 2006 (which includes Request for Cancellation of Jan. 16, 2006), 18 pages.
DE '760 Cancellation, (translation of) Decision by German Patent Office of Sep. 9, 2009, 10 pages.
Cancellation Proceeding regarding German Utility Model DE 299 24 761 (hereinafter "DE '761 Cancellation"), (translation of) Notice of Request for Cancellation of Jan. 25, 2006 (which includes Request for Cancellation of Jan. 16, 2006), 18 pages.
DE '761 Cancellation, (translation of) Petitioner's Supplemental Brief of Aug. 3, 2007, 13 pages.
DE '761 Cancellation, (translation of) Petitioner's Supplemental Brief of Jan. 30, 2008, 8 pages.
DE '761 Cancellation, (translation of) Patentee's Brief of Feb. 13, 2008, 8 pages.
DE '761 Cancellation, (translation of) Decision by German Patent Office of Apr. 16, 2008, 14 pages.
Spanish Litigation (Civil Action 522/2007-1) regarding various European patents (EP1153167,EP1060305,EP1066213, EP1140689) (hereinafter "Spanish Litigation"), (translation of) Plaintiff's Complaint, 54 pages.
Spanish Litigation, (translation of) Document 10 referred to in above Plaintiff's Complaint, Oct. 29, 2007, 36 pages.
Spanish Litigation, (translation of) Document 11 referred to in above Plaintiff's Complaint, Oct. 29, 2007, 29 pages.
Spanish Litigation, (translation of) Document 14 referred to in above Plaintiff's Complaint, Nov. 2, 2007, 53 pages.
Spanish Litigation, (translation of) Document 30 dated Jun. 30, 2008, referred to in Defendants Answer, Jul. 7, 2008, 46 pages.
Spanish Litigation, (translation of) Document 31 dated Jul. 3, 2008, referred to in Defendant's Answer, Jul. 7, 2008, 44 pages.
Spanish Litigation, (translation of) Plaintiff's Final Conclusions dated Nov. 2, 2009, 86 pages.
Schlomann-Oldenbourg, Illustrierte Technische Worterbucheh, Band 2: Die Elektrotechnik, Munchen und Berlin, 4 pages.
Feyrer, Klaus, Drahtseile, 1994, 3 pages, Mit 271 Abbildungen, Springer-Verlag, Berlin Heidelberg, New York .
Vulkollan, Angst + Pfister, 10 pages, Zurich.
U.S. Litigation (Civil Action 2:09-cv-00560-DMC-MF) regarding U.S. Patent 6,739,433, Plantiff Schindler Elevator Corporation's Invalidity Contentions, May 1, 2009, 17 pages.
Berkenhoff & Drebes GMBH, Mini-ropes and strands, Mar. 1995, pp. SCH0000034-SCH0000058.
Italian Litigation (Civil Action 74377/2006) regarding various European patents and applications (EP1056675, EP1060305,EP1066213,EP1140689,EP1153167,EP1169256, EP1208265,EP1360370,EP1427661,EP1567440,EP1568646, EP1568647,EP1580157,EP1599406,EP1631517,EP1640307, EP1642854,EP1671913,EP1676807 and EP1725375) (hereinafter "Italian Litigation"). (translation of) Plantiff's Complaint, Nov. 24, 2006, 25 pages.
Italian Litigation, (translation of) Plantiff's First Technical Brief, Jul. 28, 2008, 82 pages.
Italian Litigation, (translation of) Defendant's Second Technical Brief, Jan. 9, 2009, 126 pages.
Italian Litigation, (translation of) Plantiff's Third Technical Brief, Apr. 30, 2009, 65 pages.
Cancellation Proceeding regarding German Utility Model DE29924773 (hereinafter "DE '773 Cancellation"), (translation of) Notice of Request for Cancellation of Jan. 25, 2006 (which includes Request for Cancellation of Jan. 16, 2006), 15 pages.
Cancellation Proceeding regarding German Utility Model DE29924774 (hereinafter "DE '774 Cancellation"), (translation of) Notice of Request for Cancellation of Jan. 25, 2006 (which includes Request for Cancellation of Jan. 19, 2006), 15 pages.
DE '774 Cancellation, (translation of) Petitioner's Supplemental Brief, Sep. 28, 2006, 19 pages.
Cancellation Proceeding regarding German Utility Model DE29924775 (hereinafter "DE '775 Cancellation"), (translation of) Notice of Request for Cancellation of Jan. 25, 2006 (which includes Request for Cancellation of Jan. 19, 2006), 16 pages.
DE '775 Cancellation, (translation of) Petitioner's Supplemental Brief, Sep. 22, 2006, 21 pages.
Cancellation Proceeding regarding German Utility Model DE29924776 (hereinafter "DE '776 Cancellation"), (translation of) Notice of Request for Cancellation of Jan. 25, 2006 (which includes Request for Cancellation of Jan. 16, 2006), 15 pages.
DE '776 Cancellation, (translation of) Petitioner's Supplemental Brief of Oct. 11, 2006, 23 pages.
VDI 2758, Verein Deutscher Ingenieure, (Jun. 1993, revised Jan. 2001), 65 pages, Beuth Verlag GmbH Berlin, Dusseldorf.
German Litigation regarding European Patent EP1153167 and German Utility Model DE29924773 (Civil Action 4a O 372/05) (hereinafter "German Litigaton 372/05"), (translation of) First Instance Decision, Oct. 26, 2006, 17 pages.
German Litigation 372/05, (translation of) Second Instance Decision, Apr. 24, 2008, 30 pages.

German Litigation 372/05, (translation of) Plaintiffs Supreme Court Appeal Brief, Oct. 1, 2008, 16 pages.

German Litigation, 372/05, (translation of) Plaintiffs Additional Supreme Court Brief, Mar. 9, 2009, 4 pages.

German Litigation regarding German Utility Model DE29924776 (Civil Action 4a O 462/05) (hereinafter "German Litigation 462/05"), (translation of) First Instance Decision, Oct. 26, 2006, 13 pages.

German Litigation 462/05, (translation of) Second Instance Decision, Apr. 24, 2008, 14 pages.

German Litigation regarding German Utility Model DE29924775 (Civil Action 4a O 401/05) (hereinafter "German Litigation 401/05"), (translation of) Plaintiffs Complaint, Aug. 23, 2005, 25 pages.

German Litigation 401/05, (translation of) Defendant's Answer, Mar. 10, 2006, 10 pages.

German Litigation 401/05, (translation of) Defendant's Brief of August 8, 2006, 31 pages.

German Litigation regarding German Utility Model DE29924774 (Civil Action 4a O 463/05) (hereinafter "German Litigation 463/05") which was split from German Litigation 401/05, (translation of) Defendant's Answer, Jan. 23, 2006, 13 pages.

German Litigation 463/05, (translation of) Plaintiffs Brief, May 29, 2006, 27 pages.

German Litigation 463/05, (translation of) Defendent's Brief, Aug. 14, 2006, 26 pages.

* cited by examiner

ELEVATOR SYSTEM HAVING DRIVE MOTOR LOCATED BETWEEN ELEVATOR CAR AND HOISTWAY SIDEWALL

FIELD OF THE INVENTION

The present invention relates generally to an elevator system, and more particularly to an elevator system including a drive motor provided between an elevator car and a hoistway sidewall.

BACKGROUND OF THE INVENTION

Considerable expense is involved in the construction of a machine room for an elevator. The expense includes the cost of constructing the machine room, the structure required to support the weight of the machine room and elevator equipment, and the cost of shading adjacent properties from sunlight (e.g., sunshine laws in Japan and elsewhere).

It is an object of the present invention to provide an elevator system without a machine room which avoids the above-mentioned drawbacks associated with prior elevator systems.

It is a further object of the present invention to employ flat rope technology to reduce the size of the drive motor and sheaves so that either conventional or flat drive motors may be placed within the space between the elevator car and sidewall of the hoistway.

SUMMARY OF THE INVENTION

An elevator system includes a hoistway defined by a surrounding structure. An elevator car and counterweight are located in the hoistway, and a drive motor is located between the elevator car and a sidewall of the hoistway. The drive motor drivingly couples and suspends the elevator car and counterweight via at least one flat rope or belt.

An advantage of the present invention is that the elevator system significantly reduces the space and construction costs associated with an elevator system having a machine room.

A second advantage of the present invention is the provision of several alternative drive motor locations.

A third advantage of the present invention is that flat rope technology reduces the size of the drive motor and sheaves, and thereby reduces the space between the elevator car and sidewall of the hoistway required for accommodating the motor and sheaves.

DETAILED DESCRIPTION OF THE PREFERRED EMBODIMENTS

Figure 1:
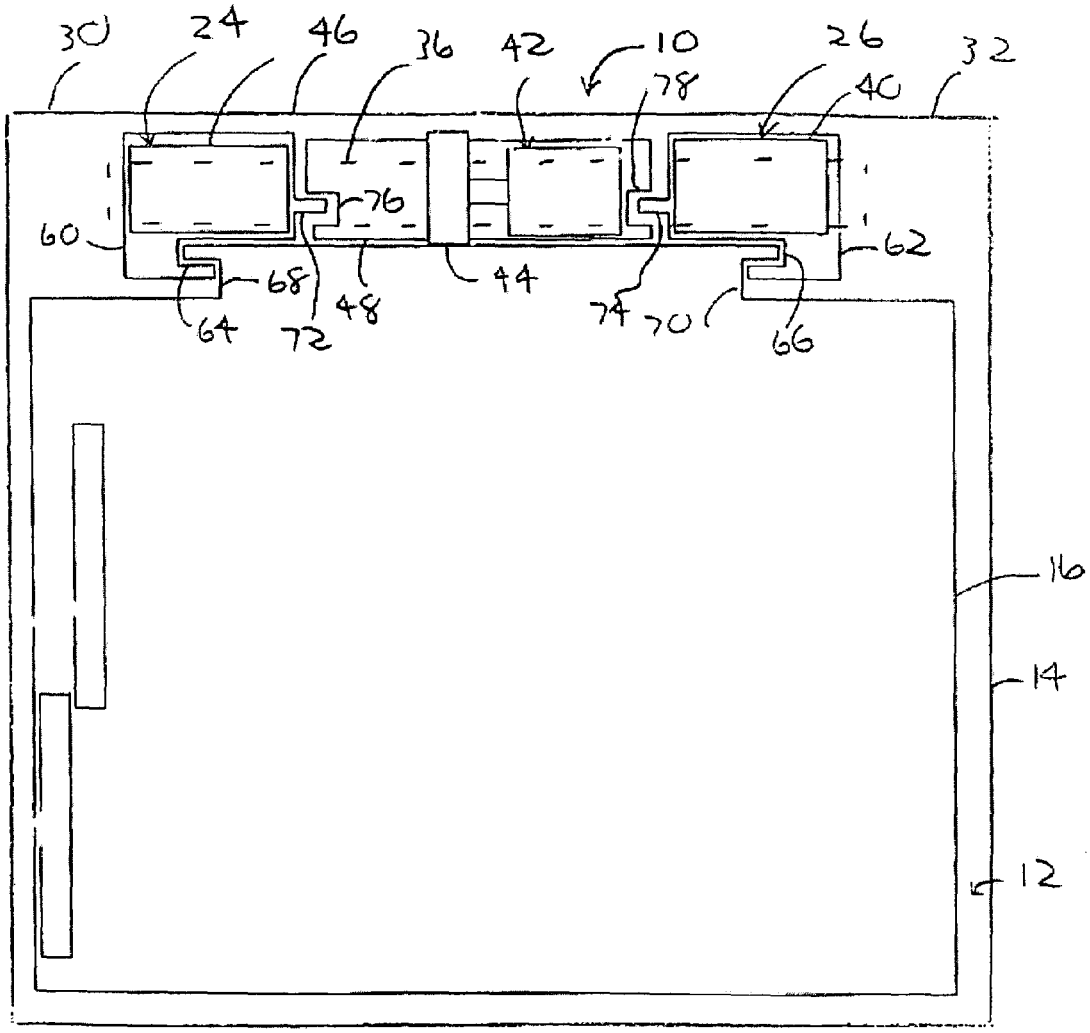
FIG. 1 is a schematic, top plan view of an elevator system embodying the present invention.
Figure 2:
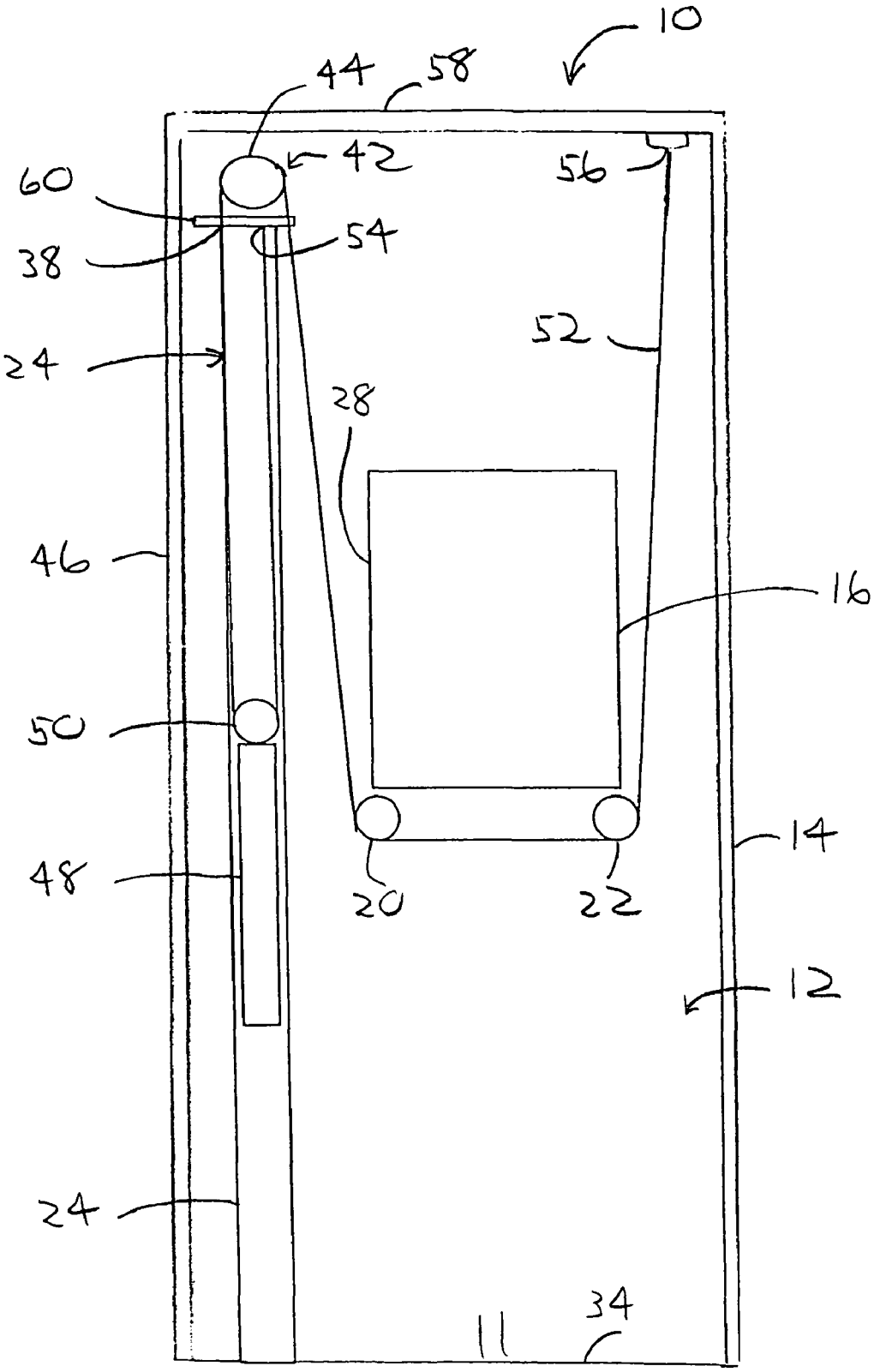
FIG. 2 is a schematic, side elevational view of the elevator system of FIG. 1 showing an underslung roping configuration.

With reference to FIGS. 1-2, an elevator system embodying the present invention is generally designated by the reference number 10. The elevator system includes a hoistway 12 defined by a surrounding structure 14. An elevator car 16 is disposed in the hoistway 12 for upward and downward movement therealong. First and second elevator sheaves 20, 22 are coupled to an underside of the elevator car 16 at opposite sides relative to each other. The elevator system 10 includes first and second support columns 24, 26 disposed at one side 28 of the elevator car 16, and generally at opposite sides 30, 32 of the hoistway 12 relative to each other. Each of the first and second support columns 24, 26 extends vertically from a bottom portion or floor 34 of the hoistway 12 to an upper portion of the hoistway. A support member 36 (shown by the dashed lines in FIG. 1) is mounted on and extends generally horizontally between the first and second support columns 24, 26 at a top portion of the hoistway 12.

A drive motor 42, including a drive sheave 44 drivingly coupled to the drive motor, is supported on the support member 36 and is aligned within a vertically extending space along the hoistway 12 between the elevator car 16 and a sidewall 46 of the hoistway.

The elevator system 10 further includes a counterweight 48 having a counterweight sheave 50 coupled to a top portion of the counterweight. The counterweight 48 is situated below and preferably aligned with the drive motor 42 in the vertically-extending space along the hoistway 12 between the elevator car 16 and the sidewall 46. The counterweight 48 is coupled to the elevator car 16 via a flat rope or belt for balancing the elevator car during its vertical movement along the hoistway 12.

The employment of flat ropes or belts permits smaller drive motors and sheaves to drive and suspend elevator car and counterweight loads relative to drive motors and sheaves using conventional round ropes. The diameter of drive sheaves used in elevators with conventional round ropes is limited to 40 times the diameter of the ropes, or larger, due to fatigue of the ropes as they repeatedly conform to the diameter of the sheave and straighten out. Flat ropes or belts have an aspect ratio greater than one, where aspect ratio is defined as the ratio of rope or belt width w to thickness t (Aspect Ratio=w/t). Therefore, flat ropes or belts are inherently thin relative to conventional round ropes. Being thin, there is less bending stress in the fibers when the belt is wrapped around a given diameter sheave. This allows the use of smaller diameter traction sheaves. Torque is proportional to the diameter of the traction sheave. Therefore, the use of a smaller diameter traction sheave reduces motor torque. Motor size (rotor volume) is roughly proportional to torque; therefore, although the mechanical output power remains the same regardless of sheave size, flat ropes or belts allow the use of a smaller drive motor operating at a higher speed relative to systems using conventional round ropes. Consequently, smaller conventional and flat drive motors may be accommodated in the hoistway between the elevator car and a sidewall of the hoistway which significantly reduces the size and construction cost of the hoistway.

In summary, reducing the machine size (i.e., drive motor and sheaves) has a number of advantages. First, the smaller machine reduces the hoistway space requirement when the machine is located above the elevator car and sidewall of the hoistway. Second, a small machine utilizes less material, and will be less costly to produce relative to a larger machine. Third, the light weight of a small machine reduces the time for handling the machine and the need for equipment to lift the machine into place so as to significantly reduce installation cost. Fourth, low torque and high speed allow the elimination of gears, which are costly. Further, gears can cause vibrations and noise, and require maintenance of lubrication. However, geared machines may be employed if desired.

Flat ropes or belts also distribute the elevator and counterweight loads over a greater surface area on the sheaves relative to round ropes for reduced specific pressure on the ropes, thus increasing its operating life. Furthermore, the flat ropes or belts may be made from a high traction material such as urethane or rubber jacket with fiber or steel reinforcement.

The flat rope 52 has first and second ends 54, 56 each coupled within a top portion of the hoistway 12. Preferably, the first end 54 of the flat rope 52 is coupled to the support member 36 and the second end 56 of the flat rope is coupled to a ceiling 58 of the hoistway 12. As shown in FIG. 2, the flat rope 52 extends downwardly from its first end 54 at the support member 36, loops generally 180° about the counterweight sheave 50, extends upwardly and loops generally 180° about the drive sheave 44, extends generally downwardly and underslings the elevator car 16 via the first and second elevator sheaves 20, 22, and extends generally upwardly and terminates at its second end 56 at the ceiling 58 of the hoistway 12.

First and second guide members 60, 62 for guiding the elevator car 16 and the counterweight 48 are respectively disposed along the length of the first and second support columns 24, 26. The guide members 60, 62 may be formed integrally with the support columns 24, 26 or may be separate from and disposed about a perimeter of the support columns. As shown in FIG. 1, the first and second guide members 60, 62 respectively define first and second elevator guide surfaces 64, 66. The first and second elevator guide surfaces 64, 66 respectively extend vertically along the first and second support columns 24, 26 at least over a length of the support columns corresponding to the path of elevator car travel. Opposing surfaces 68, 70 of the elevator car 16 are shaped to be movably engagable with respective first and second elevator guide surfaces 64, 66 as the elevator car moves vertically along the first and second support columns 24, 26. The first and second guide members 60, 62 also respectively define first and second counterweight guide surfaces 72, 74. The first and second counterweight guide surfaces 72, 74 respectively extend vertically along the first and second support columns 24, 26 at least over a length of the support columns corresponding to the path of counterweight travel. Additional opposing surfaces 76, 78 of the counterweight 48 are shaped to be movably engagable with respective first and second counterweight guide surfaces 72, 74 as the counterweight moves vertically along the support columns. For clarity in showing the roping configuration in FIG. 2, the elevator car 16 is shown as being spaced from the first and second support columns 24, 26.

In operation, the drive motor 42 is signaled by a controller (not shown) to rotate the drive sheave 44 in a counterclockwise direction to move the elevator car 16 upwardly along the hoistway 12. The counterclockwise rotating drive sheave 44 pulls a portion of the flat rope 52 between the drive sheave 44 and the elevator sheaves 20, 22 upwardly, and in turn, causes the elevator sheaves to roll along the flat rope toward its second end 56 to thereby move the elevator 16 upwardly along the hoistway 12. As the drive sheave 44 rotates in a counterclockwise direction, a portion of the flat rope 52 looping over the drive sheave 44 and extending downwardly toward the counterweight sheave 50 increases in length causing the counterweight sheave to rotate counterclockwise, whereby the counterweight 48 is lowered along the hoistway 12.

The drive motor 42 is also signaled by a controller to rotate the drive sheave 44 in a clockwise direction to move the elevator car 16 downwardly along the hoistway 12. The clockwise rotating drive sheave 44 pulls a portion of the flat rope 52 looping about the drive sheave 44 and extending downwardly toward the counterweight sheave 50 which causes the counterweight sheave to rotate in a clockwise direction, to thereby move the counterweight 48 upwardly along the hoistway 12. The clockwise rotating drive sheave 44 also lengthens a portion of the flat rope 52 between the drive sheave and the second end 56 of the flat rope 52 which causes the elevator sheaves 20, 22 to roll along the flat rope away from its second end to thereby move the elevator car 16 downwardly along the hoistway 12.

As shown in FIGS. 1-2, the provision of the drive motor within the space along the hoistway between the elevator car and a sidewall of the hoistway minimizes internal building height requirements because no machinery occupies the overhead projection of the elevator car or within the hoistway pit. The provision of the machinery to the side of the elevator car also reduces the overhead dimension of the hoistway in that space is only required for rope elongation, buffer stroke and jump allowance for the counterweight. In the example of FIG. 1, the drive sheave 44 fits within the space along the hoistway between the elevator car and the sidewall of the hoistway. In this example, the drive sheave has an outside dimension that is less than or equal to a dimension of the support columns 24, 26 (the dimensions being considered in a direction from the sidewall toward the elevator car and perpendicular to the axis of rotation of the drive sheave).

Figure 3:
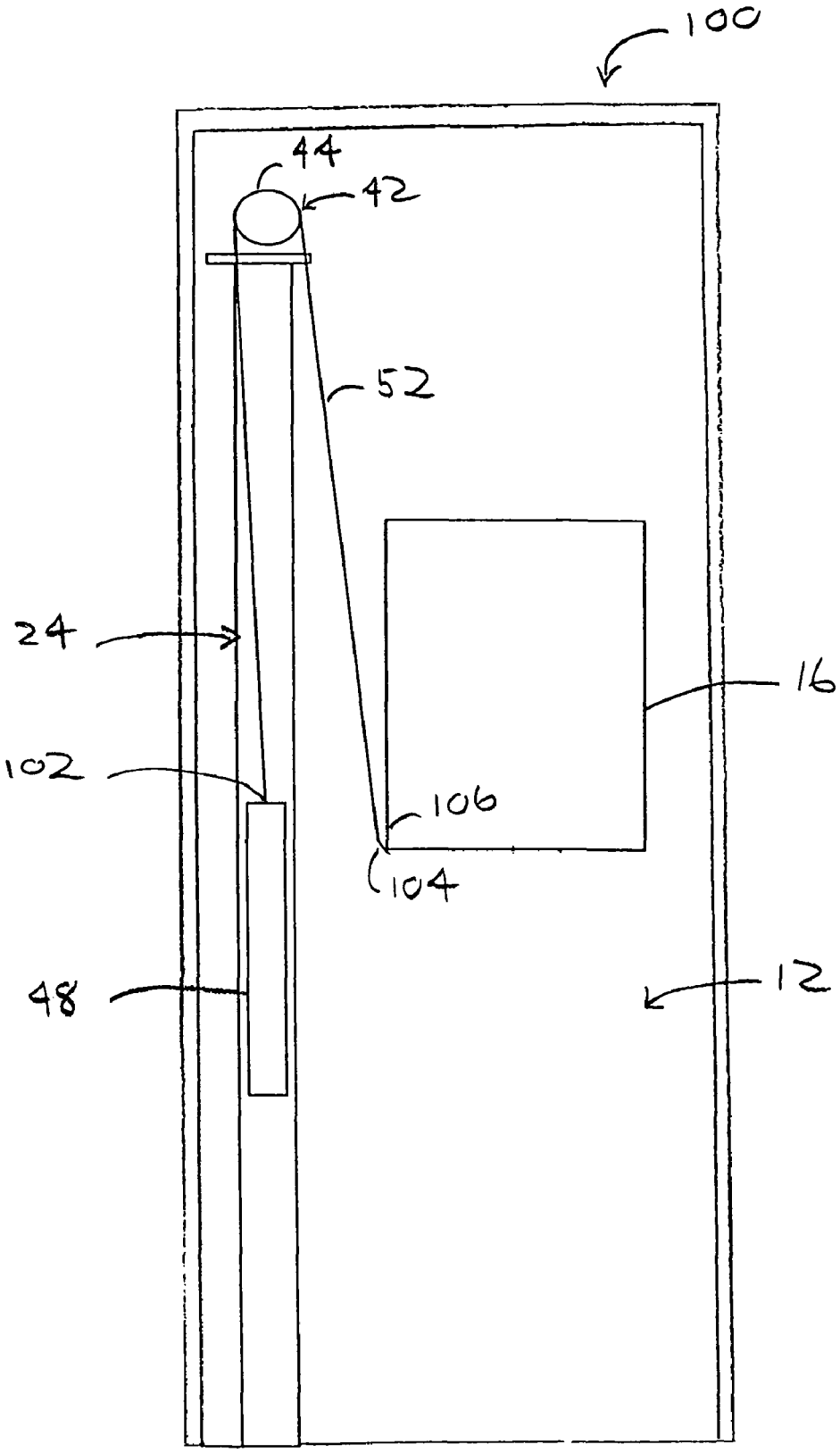
FIG. 3 is a schematic, side elevational view of a second embodiment of the present invention illustrating an elevator system employing a 1:1 roping configuration.

Turning now to FIG. 3, an elevator system in accordance with a second embodiment of the present invention is generally designated by the reference number 100. Like elements with the elevator system 10 of FIGS. 1 and 2 are labeled with like reference numbers. The elevator system 100 is similar to the elevator system 10 except that the elevator system 100 employs a 1:1 roping configuration which does not employ a counterweight sheave or elevator sheaves. The embodiment of FIG. 3 will be explained with respect to its aspects which are different from previous embodiments.

A first end 102 of the flat rope 52 is coupled to a top portion of the counterweight 48, and a second end 104 of the flat rope is coupled to a lower portion of the elevator car 16. The flat rope 52 extends generally upwardly from its first end 102 at a top portion of the counterweight 48, loops generally 180° about the drive sheave 44, and extends generally downwardly and is coupled to a lower portion of the elevator car 16 at 106. For clarity in showing the roping configuration, the elevator car 16 is shown as being spaced from the first and second support columns 24, 26.

In operation, the drive motor 42 is signaled by a controller (not shown) to rotate the drive sheave 44 in a counterclockwise direction to move the elevator car 16 upwardly along the hoistway 12. The counterclockwise rotating drive sheave 44 pulls a portion of the flat rope 52 between the drive sheave and the elevator car 16 upwardly, and in turn, causes the elevator car to move upwardly along the hoistway 12 via the guide members 60, 62. As the drive sheave 44 rotates in a counterclockwise direction, a portion of the flat rope 52 extending between the drive sheave 44 and the counterweight 48 increases in length, whereby the counterweight is lowered along the hoistway 12.

The drive motor is also signaled by a controller to rotate the drive sheave 44 in a clockwise direction to move the elevator car 16 downwardly along the hoistway 12 via the guide members 60, 62. The clockwise rotating drive sheave 44 pulls upwardly a portion of the flat rope 52 extending between the drive sheave and the counterweight 48 which causes the counterweight to move upwardly along the hoistway 12. The clockwise rotating drive sheave 44 also lengthens a portion of the flat rope 52 between the drive sheave and the elevator car 16 which causes the elevator car to move downwardly along the hoistway 12.

Figure 4:
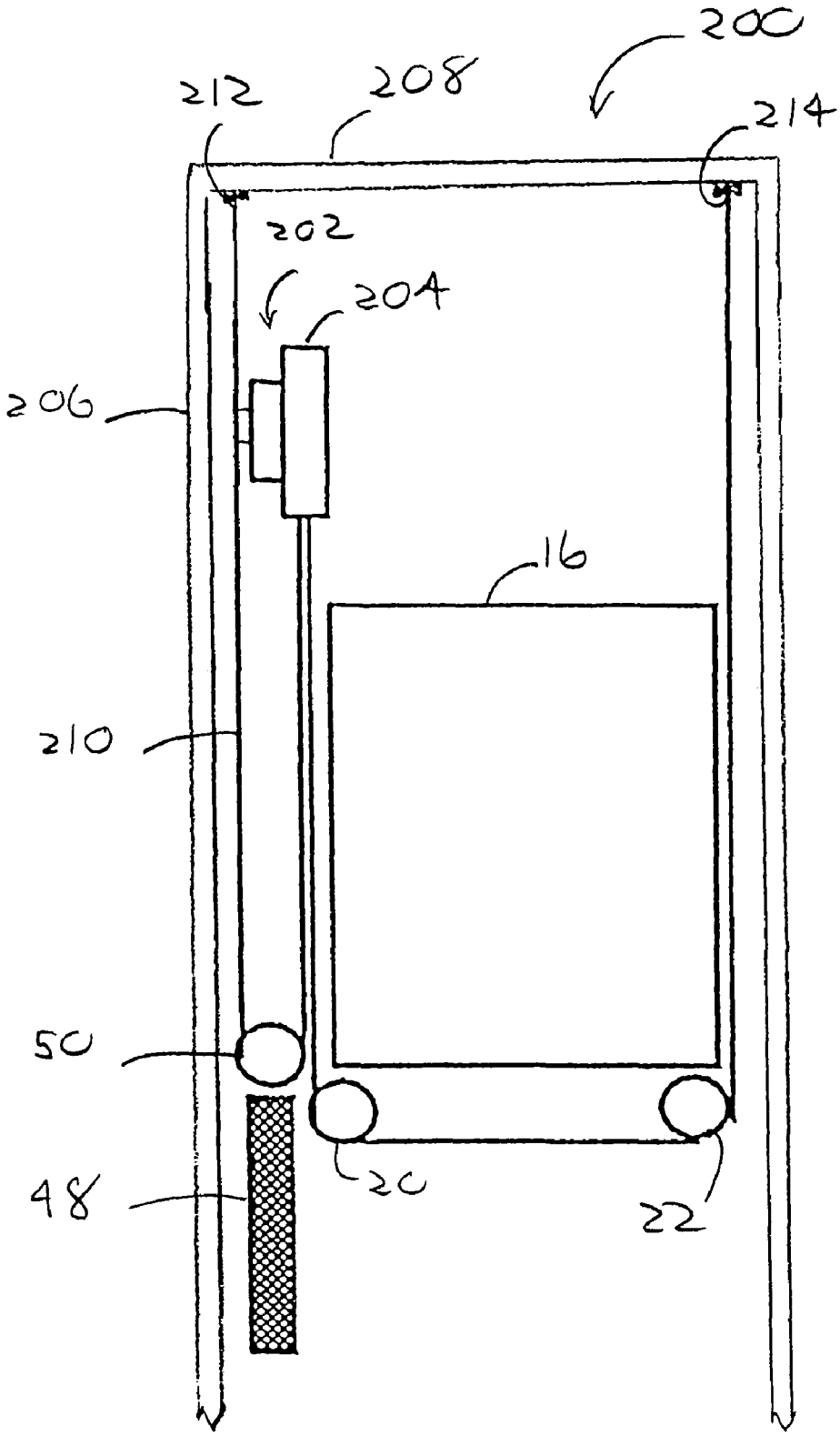
FIG. 4 is a schematic, side elevational view of another embodiment of the present invention.

Turning now to FIG. 4, an elevator system in accordance with a third embodiment of the present invention is generally designated by the reference number 200. Like elements with the previous embodiments are labeled with like reference numbers. The embodiment of FIG. 4 will be explained with respect to its aspects which are different from the previous embodiments.

A drive motor 202, and drive sheave 204 are coupled within a top portion of the hoistway 12, such as a sidewall 206 (as shown in FIG. 4) or the ceiling 208 of the hoistway. The drive motor 202 may be, for example, geared or belt-reduced to reduce the required motor torque, and is aligned within a vertically extending space of the hoistway 12 that is between an elevator car 16 disposed within the hoistway and the sidewall 206 of the hoistway. The elevator car includes first and second elevator sheaves 20, 22 coupled to an underside of the elevator car and at opposite sides of the car relative to each other. A counterweight 48 and counterweight sheave 50 coupled to its top portion are disposed below the drive motor 202, and are preferably aligned with the drive motor in the space along the hoistway 12 between the elevator car 16 and the sidewall 206. A flat rope or belt 210 has first and second ends 212, 214 coupled to a top portion of the hoistway 12. As shown in FIG. 4, the first and second ends 212, 214 are coupled to the ceiling 208 of the hoistway 12 at generally opposite sides relative to each other. The flat rope 210 extends generally downwardly from its first end 212, loops generally 180° about the counterweight sheave 50, extends generally upwardly and loops generally 180° about the drive sheave 204, extends generally downwardly and underslings the elevator car 16 via the elevator sheaves 20, 22, and extends generally upwardly and terminates at its second end 214 at the ceiling 208 of the hoistway 12. The operation of the elevator system 200 with respect to the employment of the roping configuration to move the elevator car 16 and the counterweight 48 is similar to that of the elevator system 10 of FIGS. 1 and 2, and therefore will not be further explained.

Figure 5:
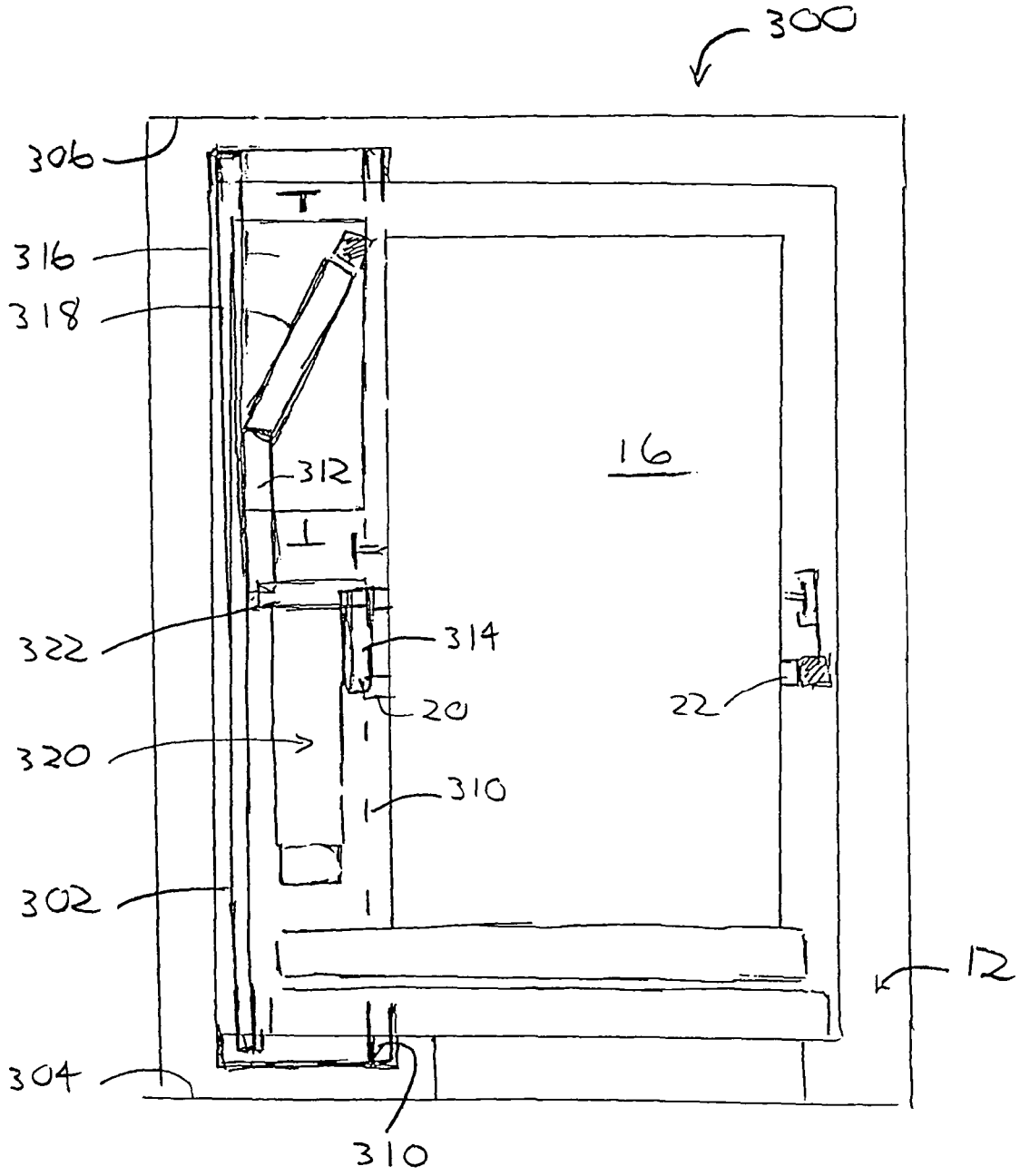
FIG. 5 is a schematic, top plan view of an elevator system in accordance with a further embodiment of the present invention showing the drive motor in the hoistway pit.
Figure 6:
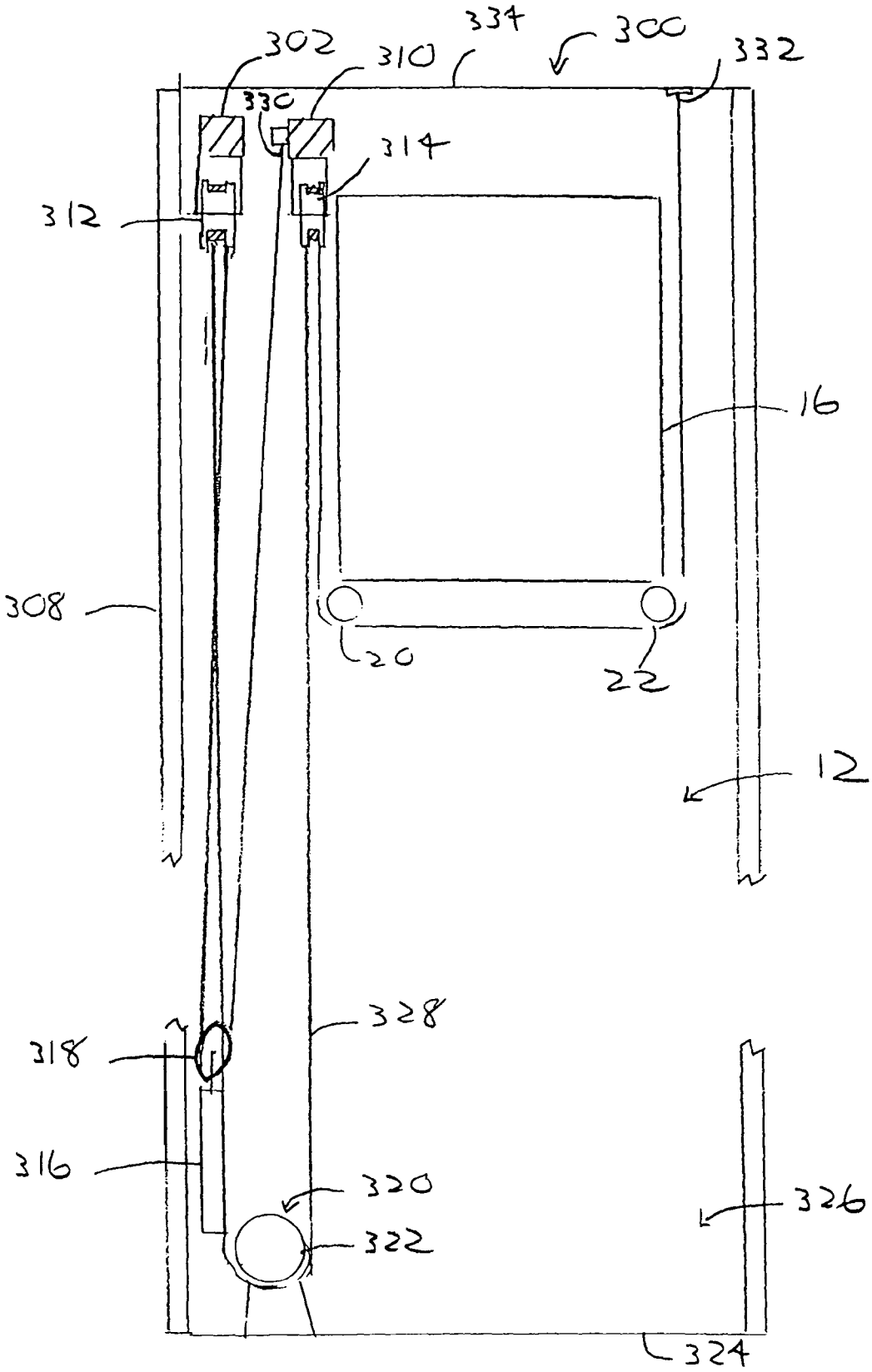
FIG. 6 is a schematic, partial, side elevational view of the elevator system of FIG. 5.

With reference to FIGS. 5 and 6, an elevator system in accordance with a further embodiment of the present invention is generally designated by the reference number 300. Like elements from previous embodiments are labeled with like reference numbers. The embodiment of FIGS. 5 and 6 will be explained with respect to its aspects which are different from the previous embodiments.

The elevator system 300 includes a first support member 302 extending generally horizontally between and coupled to opposite sides 304, 306 of the hoistway 12 at a top portion of the hoistway and is over a vertically extending space along the hoistway between an elevator car 16 and a sidewall 308 of the hoistway. A second support member 310 likewise extends generally horizontally between and is coupled to the opposite sides 304, 306 of the hoistway 12 at a top portion of the hoistway, preferably at the same level as the first support member 302. The second support member 310 is aligned over the vertically extending space along the hoistway 12 between the elevator car 16 and the sidewall 308, and is interposed between the first support member 302 and the elevator car. First and second deflector sheaves 312, 314 are respectively coupled to the first and second support members 302, 310.

A counterweight 316 having a counterweight sheave 318 coupled to its top portion is preferably disposed below the first and second support members 302, 310 within the vertically extending space along the hoistway 12 between the elevator car 16 and the sidewall 308 for easy and safe access thereto by maintenance workers. The elevator car 16 and the counterweight 316 are moved upwardly and downwardly along the hoistway 12, in part, by means of a drive motor 320, such as a direct drive brushless motor, and associated drive sheave 322 situated at a lower portion of the hoistway within the vertically extending space along the hoistway between the elevator car 16 and the sidewall 308. As shown in FIG. 6, the drive motor 320 and the drive sheave 322 are mounted to a floor 324 within a hoistway pit 326. A flat rope or belt 328 is drivingly engaged with the drive sheave 322 to move the elevator car 16 and the counterweight 316 vertically along the hoistway 12. The flat rope 328 has first and second ends 330, 332 coupled within a top portion of the hoistway 12. As shown in FIG. 6, the first end 330 of the flat rope 328 is coupled to the second support member 310 and the second end 332 is coupled to a ceiling 334 of the hoistway 12 generally at an opposite side of the elevator car 16 relative to the first end 330. The flat rope 328 extends generally downwardly from its first end 330 at the second support member 310, loops generally 180° about the drive sheave 322, extends generally upwardly and loops generally 180° about the first deflector sheave 312, extends generally downwardly and loops generally 180° about the counterweight sheave 318, extends generally upwardly and loops generally 180° about the second deflector sheave 310, extends generally downwardly and underslings the elevator car 16 via the first and second elevator sheaves 20, 22, and extends generally upwardly and terminates at its second end 332 at the ceiling 334 of the hoistway.

In operation, the drive motor 320 is signaled by a controller (not shown) to rotate the drive sheave 322 in a clockwise direction which pulls downwardly on a portion of the flat rope 328 between the drive sheave 322 and the second support member 310. This downwardly moving portion of the flat rope 328 in turn causes the second deflector sheave 314 to rotate so as to shorten the length of a portion of the flat rope between the second deflector sheave 314 and the second end 332 of the flat rope. The elevator sheaves 20, 22 are caused by this shortening portion of the flat rope 328 to roll therealong toward its second end 332, thereby moving the elevator car 16 upwardly along the hoistway 12. The clockwise rotating drive sheave 322 also moves upwardly a portion of the flat rope 328 between the drive sheave 322 and the first deflector sheave 302 causing the first deflector sheave to rotate so as to move the counterweight 316 downwardly along the hoistway 12.

The drive motor 320 is also signaled by a controller to rotate the drive sheave 322 in a counterclockwise direction which moves upwardly a portion of the flat rope 328 between the drive sheave and the second support member 310. This upwardly moving portion of the flat rope 328 in turn causes the second deflector sheave 310 to rotate so as to increase the length of a portion of the flat rope between the second deflector sheave and the second end 332 of the flat rope. The elevator sheaves 20, 22 are caused by this lengthening portion of the flat rope 328 to roll therealong away from its second end 332, thereby moving the elevator car 16 downwardly along the hoistway 12. The counterclockwise rotating drive sheave 322 also moves downwardly a portion of the flat rope 328 between the drive sheave and the first deflector sheave 302 causing the first deflector sheave to rotate so as to move the counterweight 316 upwardly along the hoistway 12.

Although this invention has been shown and described with respect to several embodiments thereof, it should be understood by those skilled in the art that the foregoing and various other changes, omissions, and additions in the form and detail thereof may be made therein without departing from the spirit and scope of the invention. For example, other roping configurations may be employed where the drive motor is disposed to the side of the hoistway between the elevator car and a sidewall of the hoistway. Further, the drive motor may also be disposed in the overhead space of the hoistway between the elevator car and a sidewall. Accordingly, the invention has been described and shown in several embodiments by way of illustration rather than limitation.

What is claimed is:

1. An elevator system comprising:

a hoistway defined by a surrounding structure;

an elevator car and counterweight located in the hoistway;

a machine, having a drive motor and a drive sheave, located between the elevator car and a sidewall of the hoistway, the drive motor drivingly coupling and suspending the elevator car and counterweight via the drive sheave and at least one flat rope, wherein the flat rope is made from a reinforceable traction material and the drive sheave, which has an axis of rotation parallel to the sidewall, is positioned from the drive motor along the sidewall and the axis of rotation;

first and second support columns located on opposite sides of the hoistway relative to each other, each of the support columns extending vertically from a bottom portion to a top portion of the hoistway between the elevator car and said sidewall of the hoistway, each of the support columns having a dimension in a direction from the sidewall toward the elevator car and perpendicular to the axis of rotation, the drive sheave having an outside dimension in the direction that is less than or equal to the support column dimension in the direction.

2. An elevator system as defined in claim 1, comprising a support member mounted on and extending generally horizontally between the first and second support columns at a top portion of the hoistway, and wherein the drive motor is supported on the support member.

3. An elevator system as defined in claim 2, wherein the counterweight is located underneath the support member between the elevator car and said sidewall of the hoistway.

4. An elevator system as defined in claim 3, further including a counterweight sheave coupled to a top portion of the counterweight, and at least one elevator sheave coupled to an underside of the elevator car, the flat rope having first and second ends fixedly coupled at a top portion of the hoistway, the flat rope extending downwardly from the first end, looping about the counterweight sheave, extending upwardly and looping about the drive sheave, extending downwardly and underslinging the elevator car via the at least one elevator sheave, and extending upwardly and terminating at the second end.

5. An elevator system as defined in claim 4, wherein the at least one elevator sheave includes first and second elevator sheaves located at an underside of the elevator car and at opposite sides relative to each other.

6. An elevator system as defined in claim 2, wherein the first and second support columns respectively include first and second guide members, each of the guide members defining an elevator guide surface extending vertically therealong at least over a length of the support columns corresponding to the path of elevator car travel, and the elevator car defining opposing surfaces shaped to be movably engagable with the elevator guide surfaces as the elevator car moves vertically along the support columns.

7. An elevator system as defined in claim 6, wherein each of the first and second guide members further defines a counterweight guide surface extending vertically therealong at least over a length of the support columns corresponding to the path of counterweight travel, and the counterweight defines additional opposing surfaces shaped to be movably engagable with the counterweight guide surfaces as the counterweight moves vertically along the support columns.

8. An elevator system as defined in claim 1, wherein the flat rope is reinforced with steel.

9. An elevator system as defined in claim 1, wherein the flat rope is reinforced with fiber.

10. An elevator system as defined in claim 1, wherein the traction material is urethane.

11. An elevator system as defined in claim 1, wherein the traction material is rubber.

12. An elevator system as defined in claim 2, wherein the counterweight is located underneath the support member between the elevator car and the sidewall of the hoistway, the flat rope has a first end coupled to a top portion of the counterweight and a second end coupled to the elevator car, the flat rope extending upwardly from its first end at the counterweight, looping about the drive sheave, and extending downwardly and terminating at its second end at the elevator car to form a 1:1 roping configuration.

13. An elevator system as defined in claim 2, wherein the counterweight is located underneath the support member between the elevator car and the sidewall of the hoistway, and including a counterweight sheave coupled to a top portion of the counterweight, at least one elevator sheave coupled to an underside of the elevator car, and the flat rope extends downwardly from its first end, loops about the counterweight sheave, extends upwardly and loops about the drive sheave, extends downwardly and underslings the elevator car via the at least one elevator sheave, and extends upwardly and terminates at its second end.

14. An elevator system as defined in claim 4, wherein the first end of the flat rope is coupled to the support member.

* * * * *